United States Patent [19]

Bollinger et al.

[11] Patent Number: 4,883,134

[45] Date of Patent: Nov. 28, 1989

[54] MILLING MACHINE FOR CUTTING TRENCHES

[75] Inventors: Karl Bollinger, Rueil-Malmaison; Daniel Barre, Moret-sur-Loing, both of France

[73] Assignee: Soletanche, Nanterre, France

[21] Appl. No.: 101,173

[22] Filed: Sep. 25, 1987

[30] Foreign Application Priority Data

Sep. 26, 1986 [FR] France ..... 86 13468

[51] Int. Cl.[4] ..... E21B 4/04; E21B 10/00

[52] U.S. Cl. ..... 175/96; 37/189; 299/89

[58] Field of Search ..... 37/91, 94, 189, 190; 175/91, 95, 96, 97; 299/89

[56] References Cited

U.S. PATENT DOCUMENTS

| | | | |
|---|---|---|---|
| 1,483,257 | 8/1922 | Von Balluseck | 37/94 |
| 3,894,587 | 7/1975 | Sourice | 175/91 |
| 4,098,539 | 7/1978 | Zitz et al. | 299/89 X |
| 4,172,616 | 10/1979 | Delli-Gatti, Jr. | 299/89 X |
| 4,179,829 | 12/1979 | Kinkade | 37/94 |
| 4,785,559 | 11/1988 | Hentschel | 37/94 |

FOREIGN PATENT DOCUMENTS

| | | | |
|---|---|---|---|
| 504446 | 7/1920 | France . | |
| 1545629 | 11/1968 | France . | |
| 2211927 | 7/1974 | France . | |
| 2483488 | 12/1981 | France . | |
| 2578876 | 9/1986 | France . | |
| 499383 | 3/1976 | U.S.S.R. | 37/189 |

*Primary Examiner*—Edgar S. Burr
*Assistant Examiner*—Moshe I. Cohen
*Attorney, Agent, or Firm*—Schweitzer & Cornman

[57] ABSTRACT

The invention relates to a motor-driven milling machine construction for cutting trenches in the ground, in which there are two rotating semi-drums with cutting tools at their periphery. The drums are mounted on a central support. The sole function of the motor is to transmit a rotational torque to the semi-drums without transmitting any other forces. The stress exerted on the cutting tools is directly transmitted to the central support without going through the motor frame.

6 Claims, 2 Drawing Sheets

MILLING MACHINE FOR CUTTING TRENCHES

The present invention relates to a milling engine for cutting trenches in the ground.

BACKGROUND OF THE INVENTION

Such machines are already known. They have on their lower part two milling drums with parallel horizontal axes and tools on their periphery which are made to rotate in opposite directions and thus cut trenches by progressively loosening the soil and gathering between them the resulting materials which are then aspirated by a pump.

According to known design, each drum is made of two semi-drums supported on either side of a thin, flat, metallic part which is vertical and perpendicular to the drum's axis.

Since the weight of the machine is what makes it sink into the ground as the soil is loosened by the tools located on the drums, it is of utmost importance, when working in rocky soil, that the central part be as thin or narrow as possible because the tools cannot loosen soil located under this central part.

Furthermore, since the operating drums are subjected to very high stress and sizable vibrations, the typical hydraulic motors whose frames are fastened to the central part and whose central shafts support the semi-drums are subjected to such strain that they have a rather short life expectancy.

SUMMARY OF THE PRESENT INVENTION

The present invention relates to a new arrangement for mounting motors on such milling machines, which arrangement has the advantage of ensuring greater rigidity of the central support, as well as avoiding that the motors themselves be subjected to the stress and vibrations being exerted on the drums.

In this manner, in accordance with the invention, the stress being exerted on the tools is directly transmitted to the central support without going through the motor's frame whose role is only to communicate the driving forces to the drums.

The object of the present invention is a machine of the type mentioned previously, characterized by the fact that the central support for the two semi-drums is made of a vertical plate through which goes a hollow tubular bushing with a horizontal axis, coaxial with the drum, placed inside the bushing is the driving motor for the semi-drum; the motor housing is fixed to the bushing; a bearing support plate is fastened to each of the extremities of the bushing in order to support the rotation of the corresponding semi-drums whose driving is effected by the motor shaft.

In an advantageous specific design, the driving of the semi-drums is effected by a grooved shaft which fits into grooves inside the motor shaft as well as in grooved openings in two plates located on either side of the motor and each rotating together with a semi-drum.

In a preferred variation of this design, the grooves of the motor shaft fit in the corresponding grooves in a hollow drive shaft and in the grooves in the end plates with enough play so that the only stress transmitted by the motor to the plates is the driving force which makes the two semi-drums rotate.

In another variation, should one desire, for example, to drive the drums at a slower rotation speed than that of the motor (in order to increase the power of the motor by increasing its rotation speed), a reduction train of gears can be installed in place of the two plates, in between the extremities of the grooves shaft and the semi-drums.

In accordance with the invention, it is also advantageous to use a hollow grooved shaft and put a variable volume compensation chamber inside (for example, an elastomer), which ensures equal pressure on both sides of the gaskets.

In order to better explain the invention, we will now describe by way of example and without any limitative aspect, two of the designs as represented on the annexed drawings.

DETAILED DESCRIPTION OF INVENTION

Figure 1:
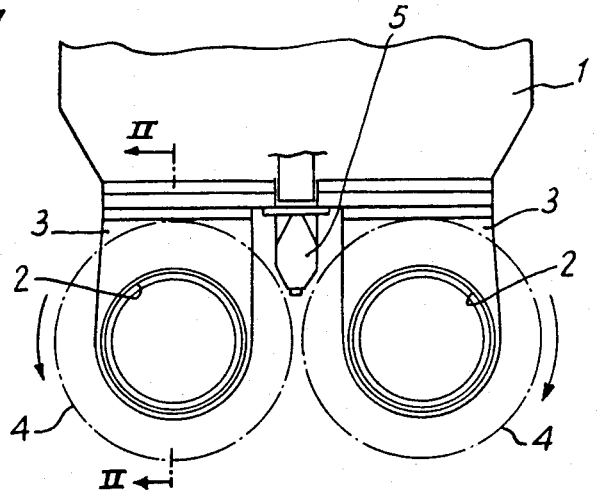
FIG. 1 is a diagrammatical view in elevation representing the lower part of a machine of the type embodying the present invention.

Represented on FIG. 1 is the lower portion of the engine body 1 which has two drums 2 placed at the same level and turning around two parallel axes in the direction shown by the arrows.

Each of these drums consists of two semi-drums placed on either side of a central portion 3 and fastened to the lower portion of the machine.

The drums 2 are equipped with tools, the periphery of which is outlined by dotted circles.

In between the two drums 2 is located the opening 5 for an aspirating pump (not shown here) which brings back to the surface pieces of soil loosened by the tools 4 during the rotation of the drums.

Figure 2:
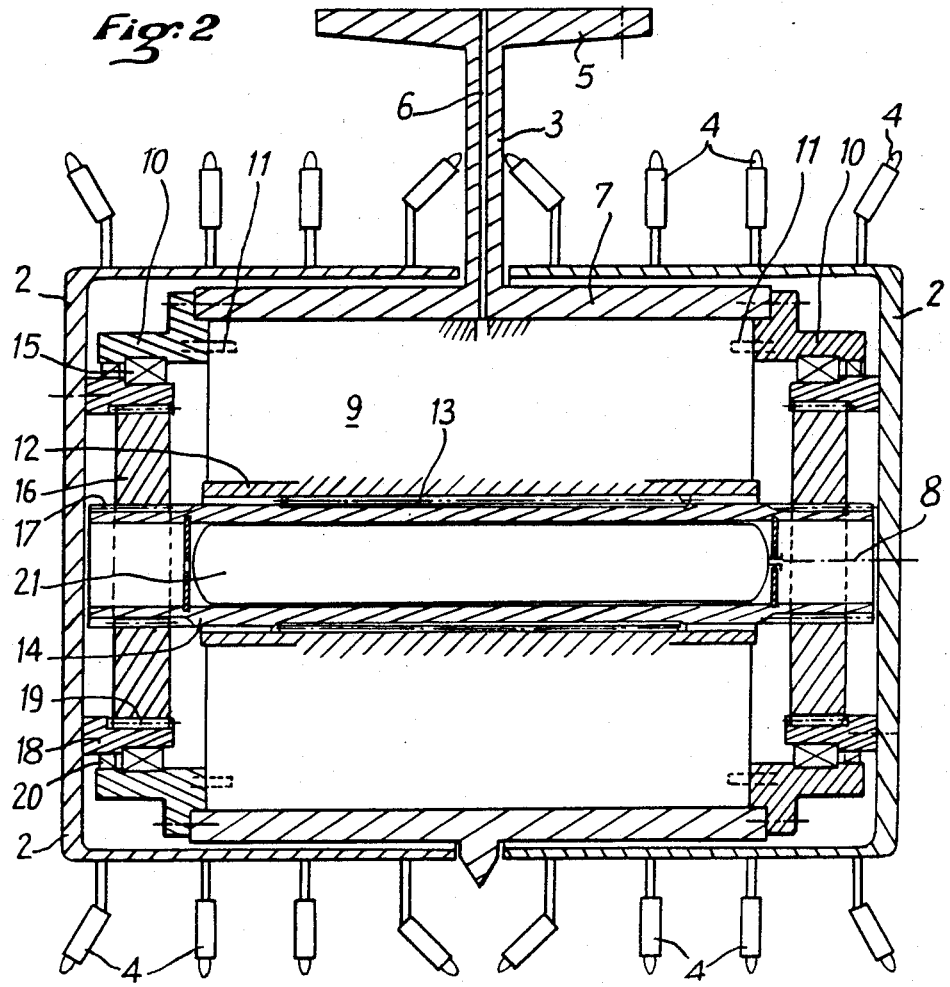
FIG. 2 is an enlarged cross sectional view taken along line II—II of FIG. 1.

Again on FIG. 2, one can see the central plate 3 joined to a web 5 through which it is securely fastened to the lower part of the machine body 1.

Schematically represented on the drawing is a pipe 6 which runs through the main plate 3 and brings the necessary energy to drive the motor. Such energy could advantageously consist of a hydraulic fluid, or could also be electric energy, for example.

In accordance with the invention, the central plate 3 has a cylindrical bushing 7 whose horizontal axis 8 is perpendicular to the plane of the central plate 3.

The bushing 7 interior diameter corresponds more or less to the exterior diameter of the motor 9 which is schematically represented on this drawing.

A bearing support plate 10 is fastened with screws (schematically represented by their axes drawn in dotted lines) to the extremities of the bushing 7. Screws 11 schematically represented connect the motor 9 to the plates 10.

In accordance with the invention, the screws are essentially used to fix the rotating motor 9 in relation to the bushing 7, since the plates are securely fastened on that same bushing by the screws previously mentioned.

The hollow shaft 12 of the motor 9 has internal grooves 13 (schematically represented) which correspond to grooves on the shaft 14 which drives the semi-drums 2.

For that, the semi-drums 2 are mounted on the plates 10 by bearings 15 (for example roller bearings); a grooved plate 16 fits in grooves 17 at the extremities of shaft 14 and thus ensures that the two semi-drums 2 rotate together with shaft 14 and therefore with the motor shaft 12.

In the design shown on FIG. 2, each plate 16 is joined to the semi-drum 2 crown also by grooves 19 which, because of the amount of play allowed, prevent any stress other than the driving force from being transmitted between the semi-drums 2, the shaft 14 and the motor 9.

Finally, schematically represented on the drawing are protective gaskets 20 which prevent fragments of soil loosened by the working of the tools 4 mounted on the drum 2 from filtering through to the bearings 15.

In these circumstances, it is easy to understand that the rotation movement transmitted from motor 9 to semi-drums 2 through shaft 14 (which, due to the grooves 13 and 17 is mounted in a floating manner in relation to motor 9 as well as to the semi-drums 2) prevents any strain other than the driving couple on the semi-drums from having repercussions on the motor which, in other respects, is protected from all vibrations due to the tools' work.

In other words, in accordance with the invention, there is a total dissociation of the motor's function-communicating only a rotational force to the semi-drums, and the central support plate's function-directly bearing all other forms of stress as well as the drum's vibrations, due to the fact that the semi-drums 2, through the bearings 15, are directly mounted on the plates 10 which in turn are securely fastened to the extremities of bushing 7.

Furthermore, bushing 7 intersects the central plate 3 noticeably stiffens the plate 3 which becomes better able to withstand all forms of strain inherent to this type of machine.

According to the preferred design represented on FIG. 2, the shaft 14 is hollow and has an inside variable volume chamber 21 which makes it possible, as it is well known, to equalize pressures on both sides of the gaskets 20 which are then protected against eventual damage.

Figure 3:
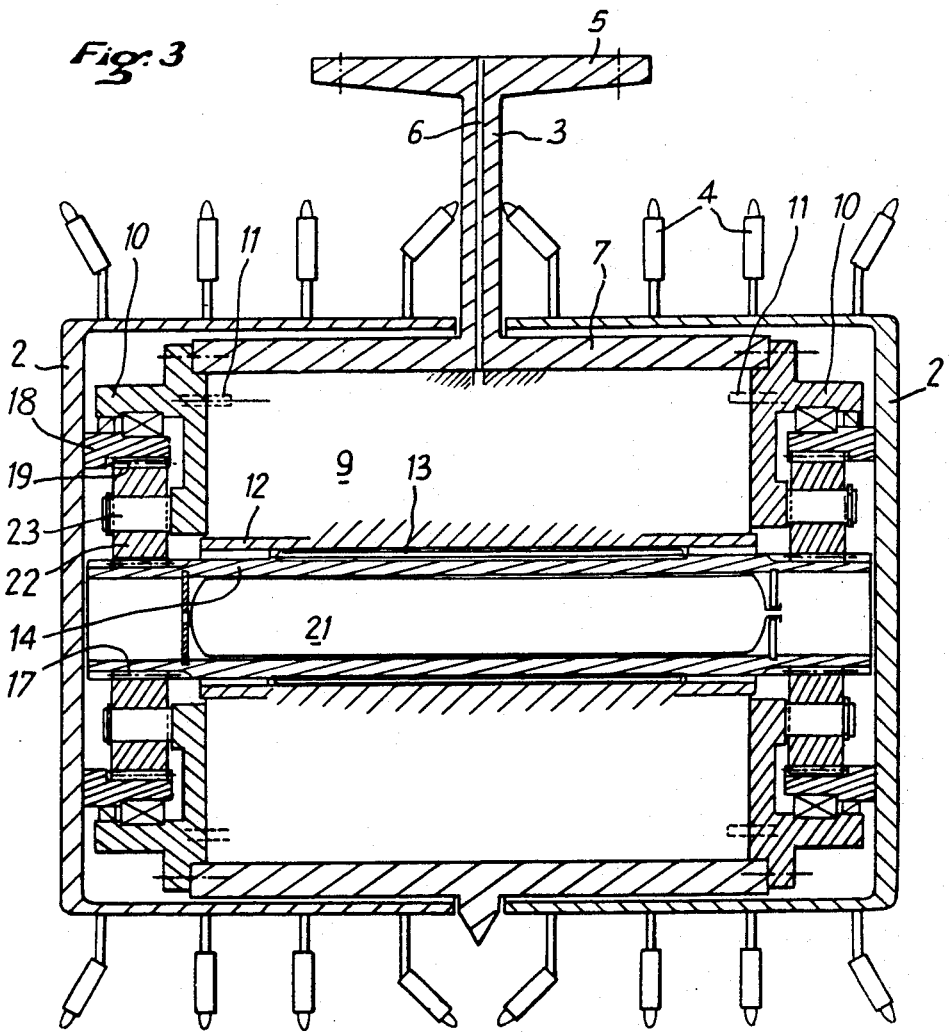
FIG. 3 is a cross section of a variation of the device represented in FIG. 2.

In the design represented on FIG. 3, the device has basically the same structure; however, the semi-drums 2 are made to rotate by a driving gear train 22 turning on shafts 23 joined to plates 10. These gears engage, on one hand in grooves 17 at each extremity of shaft 14, and on the other hand on a groove 19 on a ring gear 18 fixed to each semi-drum 2.

By choosing the respective diameters of the shaft 14 and the gears 22, it is possible to have the semi-drums turn at a different speed and in particular at a lower speed than that of motor 9.

Figure 4:
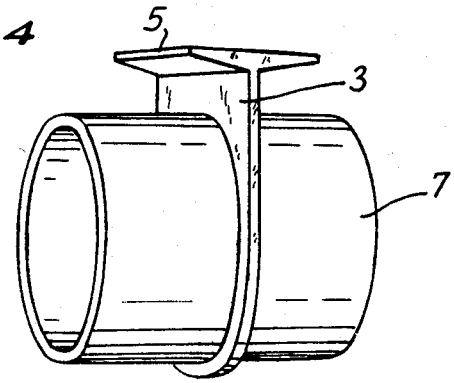
FIG. 4 is a perspective view of the central plate and its bushing, in accordance with the invention.

FIG. 4 schematically represents a view in perspective of the central plate 3 with its bushing 7.

This figure shows that the bushing axis 7 is horizontal and perpendicular to the central plate 3 which is integral with web 5, securely fastening it to the bottom part of the machine.

It is understood that the designs above described present no limitative aspect and can be given any necessary modification without departing from the scope of the invention.

In particular, it is clear that insofar as the hollow motor shaft is free from the semi-drums when it comes to all forms of strain other than the driving force that makes the semi-drums rotate, it is possible to achieve by mechanical means other than those here described the coupling of the drive shaft which goes through the hollow shaft of the motor and the semi-drums which are supported through the means of bearings joined to plates fastened to the ends of the bushing.

We claim:

1. Milling apparatus for cutting trenches in the ground comprising:

(a) a central support arm in the form of a vertical plate;

(b) a hollow cylindrical bushing with a horizontal axis intersecting said plate;

(c) a bearing support plate supported on said bushing and fastened at each of its extremities;

(d) two semi-drums with cutting tools surrounding said bushing and being supported on each of said bearing support plates by means of bearings; and (d) a motor having a housing and a rotor located inside said bushing means maintaining said housing against rotation relative to said bushing, said rotor being rotatively connected to said semi-drums.

2. Apparatus according to claim 1, in which:

(a) said motor bears a hollow rotor shaft having internal grooves;

(b) a driving shaft comprising external grooves engaged inside said hollow shaft for coupling in rotation said driving shaft and said hollow shaft, (c) said driving shaft being rotatively connected at each of its ends to one of said semi-drums.

3. Apparatus according to claim 2, in which the driving shaft is connected to the semi-drums by means of interengaging grooves.

4. Apparatus according to claim 3, in which the interengaging grooves connect the hollow rotor shaft to the semi-drums without the transmission of substantial forces other than rotational torque.

5. Apparatus according to claim 3, in which the rotor of the motor is connected to the semi-drums through a planetary gear train.

6. Apparatus according to claim 3, in which (a) gasket means are provided to protect said bearings;

(b) a variable volume compensation element is located inside the driving shaft for balancing the pressures on both sides of said gasket means.

* * * * *